US008012891B2

(12) United States Patent
Li et al.

(10) Patent No.: US 8,012,891 B2
(45) **Date of Patent: *Sep. 6, 2011**

(54) FLAME RESISTANT FABRICS AND PROCESS FOR MAKING

(75) Inventors: Shulong Li, Spartanburg, SC (US); Richard A. Mayernik, Simpsonville, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/770,951

(22) Filed: Apr. 30, 2010

(65) Prior Publication Data

US 2010/0210162 A1 Aug. 19, 2010

Related U.S. Application Data

(63) Continuation of application No. 12/261,361, filed on Oct. 30, 2008, now Pat. No. 7,713,891, which is a continuation of application No. 12/006,697, filed on Jan. 4, 2008, now abandoned, which is a continuation-in-part of application No. 11/765,002, filed on Jun. 19, 2007, now abandoned.

(51) Int. Cl.
*B32B 27/04* (2006.01)
*B32B 27/12* (2006.01)
*B32B 5/02* (2006.01)

(52) U.S. Cl. ..... 442/143; 428/920; 428/921; 442/136; 442/141; 442/142

(58) Field of Classification Search ..... 428/920, 428/921; 442/136, 141, 142, 143
See application file for complete search history.

(56) References Cited

U.S. PATENT DOCUMENTS

| | | | |
|---|---|---|---|
| 3,900,664 | A | 8/1975 | Miller |
| 3,931,310 | A | 1/1976 | Nachbur et al. |
| 4,035,542 | A | 7/1977 | Rosenthal et al. |
| 4,078,101 | A | 3/1978 | Cole |
| 4,092,108 | A | 5/1978 | Valko et al. |
| 4,098,704 | A | 7/1978 | Sandler |

(Continued)

FOREIGN PATENT DOCUMENTS

| | | |
|---|---|---|
| EP | 0 248 553 | 1/1993 |

(Continued)

OTHER PUBLICATIONS

U.S. Appl. No. 12/261,361, filed Oct. 30, 2008, Patented.

(Continued)

*Primary Examiner* — Norca L Torres-Velazquez
(74) *Attorney, Agent, or Firm* — Robert M. Lanning

(57) ABSTRACT

A process for imparting flame resistance and the flame resistant fabrics produced by such process are provided. The process for imparting flame resistant properties involves treating a target fabric with one or more flame retardant chemicals (and, preferably, a softening agent) and then curing the treated fabric to durably affix the flame retardant to the fabric. In many cases, it may be desirable to subject the treated fabric to mechanical face finishing to increase softness. Optionally, stain release agents, soil repellent agents, permanent press resins, and the like may be added to the bath of flame retardant chemicals, eliminating the need for one or more additional manufacturing processes. Alternately, soil repellent agents may be applied to only one side of the treated fabric after the application of the flame retardant chemicals. The present fabrics exhibit improved performance and tear strength, even after repeated launderings, as compared to conventionally treated fabrics.

21 Claims, 1 Drawing Sheet

U.S. PATENT DOCUMENTS

| | | | | |
|---|---|---|---|---|
| 4,145,463 | A | | 3/1979 | Cole |
| 4,151,322 | A | | 4/1979 | Rosenthal et al. |
| 4,154,463 | A | | 5/1979 | Burri |
| 4,178,399 | A | | 12/1979 | Hall et al. |
| 4,311,855 | A | | 1/1982 | Cole et al. |
| 4,419,401 | A | | 12/1983 | Pearson |
| 4,494,954 | A | | 1/1985 | Suminoe et al. |
| 4,513,042 | A | | 4/1985 | Lumb |
| 4,631,788 | A | | 12/1986 | Dischler et al. |
| 4,732,789 | A | * | 3/1988 | Hauser et al. ..... 427/393.3 |
| 4,750,911 | A | | 6/1988 | Hansen et al. |
| 4,812,144 | A | | 3/1989 | Hansen |
| 4,837,902 | A | | 6/1989 | Dischler |
| 4,842,609 | A | | 6/1989 | Johnson |
| 4,868,041 | A | | 9/1989 | Yamagishi et al. |
| 4,909,805 | A | | 3/1990 | Smith |
| 4,918,795 | A | | 4/1990 | Dischler |
| 4,920,000 | A | | 4/1990 | Green |
| 4,990,368 | A | | 2/1991 | Johnson et al. |
| 5,033,143 | A | | 7/1991 | Love, III |
| 5,223,224 | A | | 6/1993 | Dremel et al. |
| 5,238,464 | A | | 8/1993 | Johnson et al. |
| 5,356,700 | A | | 10/1994 | Tanaka et al. |
| 5,468,545 | A | | 11/1995 | Fleming et al. |
| 5,506,042 | A | | 4/1996 | Ichibori et al. |
| 5,579,207 | A | | 11/1996 | Hayden et al. |
| 5,822,835 | A | | 10/1998 | Dischler |
| 5,876,849 | A | | 3/1999 | Green |
| 5,928,971 | A | | 7/1999 | Ellis et al. |
| 6,358,608 | B1 | | 3/2002 | Hanyon et al. |
| 6,546,605 | B1 | | 4/2003 | Emery et al. |
| 6,626,964 | B1 | | 9/2003 | Lunsford et al. |
| 6,787,228 | B2 | | 9/2004 | Campbell et al. |
| 7,156,888 | B2 | | 1/2007 | Mochizuki |
| 7,182,991 | B1 | | 2/2007 | Hirschmann, Jr. et al. |
| 7,402,538 | B2 | | 7/2008 | Bader et al. |
| 2003/0228812 | A1 | | 12/2003 | Stanhope et al. |
| 2004/0138083 | A1 | | 7/2004 | Kimbrell, Jr. et al. |
| 2005/0085145 | A1 | | 4/2005 | Fang et al. |
| 2006/0292953 | A1 | | 12/2006 | Ashley et al. |
| 2008/0038973 | A1 | * | 2/2008 | Sasser et al. ..... 442/181 |

FOREIGN PATENT DOCUMENTS

| | | | |
|---|---|---|---|
| EP | 0 688 898 | * | 6/1995 |
| EP | 0 688 898 | A1 | 12/1995 |
| EP | 0 704 570 | | 4/1996 |
| JP | 52-128498 | | 10/1977 |

OTHER PUBLICATIONS

U.S. Appl. No. 12/006,697, filed Jan. 4, 2008, Abandoned.
U.S. Appl. No. 11/765,002, filed Jun. 19, 2007, Abandoned.
U.S. Appl. No. 11/503,006, filed date Aug. 10, 2006, Sasser et al.
Cytec, Pyroset TPC Flame Retardant: An application manual for a wash durable, flame retardant finish to cellulosic blends, Oct. 2004, 33 pages.

* cited by examiner

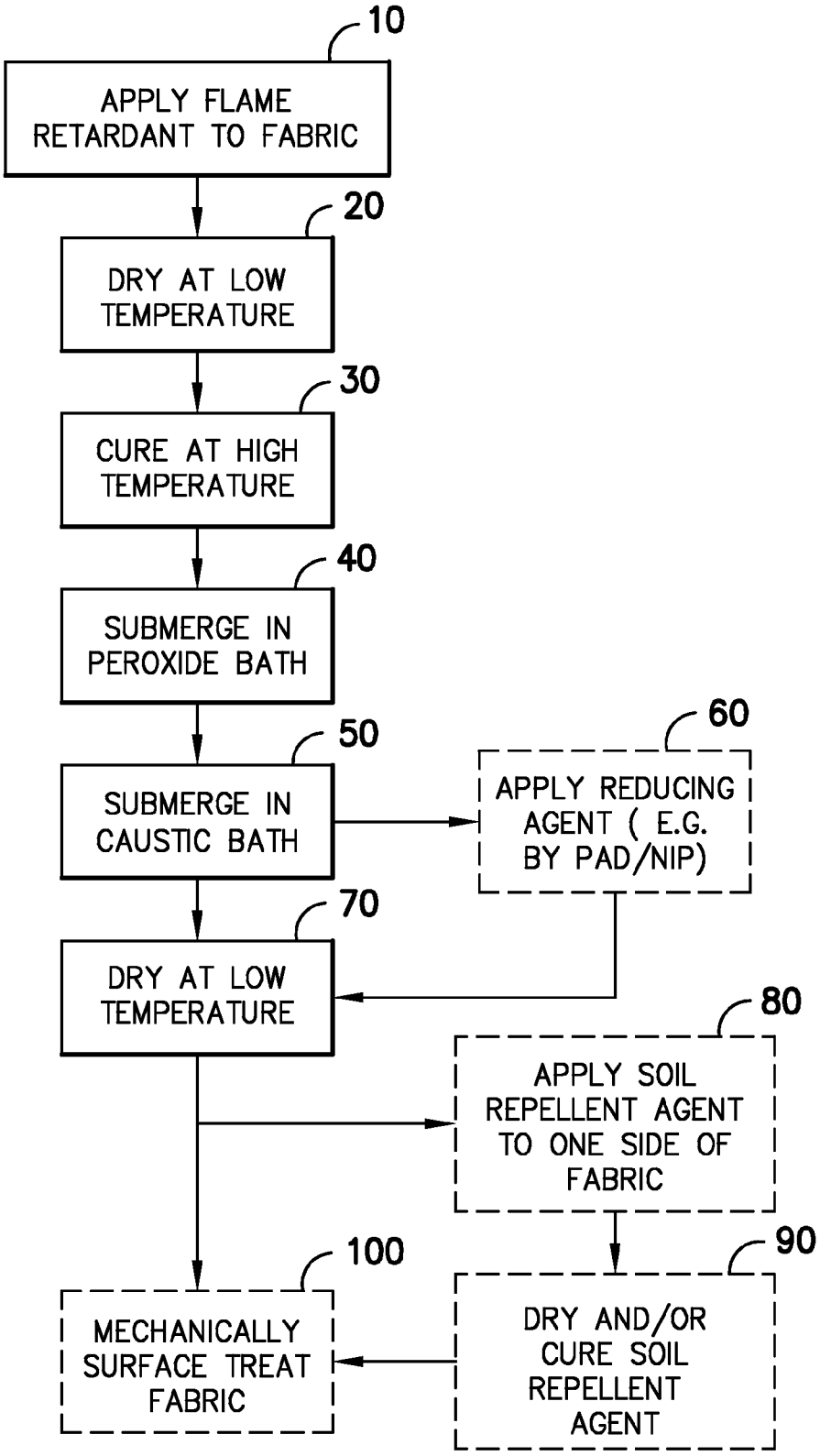
*FIG. —1—*

FLAME RESISTANT FABRICS AND PROCESS FOR MAKING

CROSS-REFERENCE TO RELATED APPLICATIONS

This application is a continuation of U.S. patent application Ser. No. 12/261,361, filed on Oct. 30, 2008 and entitled "Flame Resistant Fabrics and Process for Making", now U.S. Pat. No. 7,713,891, which is a continuation of U.S. patent application Ser. No. 12/006,697, filed on Jan. 4, 2008 and entitled "Flame Resistant Fabrics and Process for Making," now abandoned, which is a continuation-in-part (CIP) of U.S. patent application Ser. No. 11/765,002, filed Jun. 19, 2007 and entitled "Flame Resistant Fabrics Having a High Synthetic Content and Process for Making," now abandoned, the disclosures of all of which are hereby incorporated by reference in their entirety.

TECHNICAL FIELD

Described herein are processes and chemicals for imparting flame resistance to textile fabrics and to the flame resistant fabrics so produced. Such fabrics may be either 100% cellulosic or may be a blend of cellulosic and synthetic fibers, having up to 65% synthetic content by weight. The present processes include the application and curing of one or more flame retardant compounds (without the use of the ammoniation process), the neutralization of odors associated with such compounds, and, preferably, the mechanical surface treatment of the fabrics treated with the flame retardant compounds. The resultant fabrics have a durable flame resistant finish and exhibit permanent press characteristics, soft hand, and good tear strength, these characteristics being atypical of conventionally treated flame resistant fabrics.

resistant because of the innate properties of the fiber, the twist level of the yarn, the fabric construction, or, as will be discussed herein, the presence of flame retardant chemicals applied to the fabric.

The term "flame retardant" or "flame retardant chemical" refers to a chemical compound that may be applied as a topical treatment to a fiber, fabric, or other textile item during processing to reduce its flammability. In the present case, flame retardant chemicals are applied to the already constructed fabric substrate to produce a flame resistant fabric.

Flame resistant fabrics are useful in many applications, including the production of garments worn by workers in a variety of industries, including the military, electrical (for arc protection), petroleum chemical manufacturing, and emergency response fields. Cellulosic or cellulosic-blend fabrics have typically been preferred for these garments, due to the relative ease with which these fabrics may be made flame resistant and the relative comfort of such fabrics to the wearer.

Conventionally, to achieve such flame resistant properties in cellulosic-containing fabrics, the fabrics are subjected to an "ammonia process" or "ammoniation process" in which the target fabric is dipped in a bath containing a phosphorous-based flame retardant chemical, dried at relatively low temperatures, conveyed through a chamber containing gaseous ammonia, and then dipped in separate baths of peroxide and caustic before drying.

The first step of the ammoniation process involves reacting a tetra (hydroxymethyl) phosphonium compound with urea to produce a THP pre-condensate. (Such pre-condensates are commercially available, under tradenames such as PYROSAN® CFR from Emerald Performance Materials, and, accordingly, the synthesis of these compounds is omitted from the illustration below.) As shown below, the pre-condensate is reacted on the fabric surface with gaseous ammonia (typically with 15% moisture) to create an intermediate compound in which the phosphorous compound is present in its trivalent form.

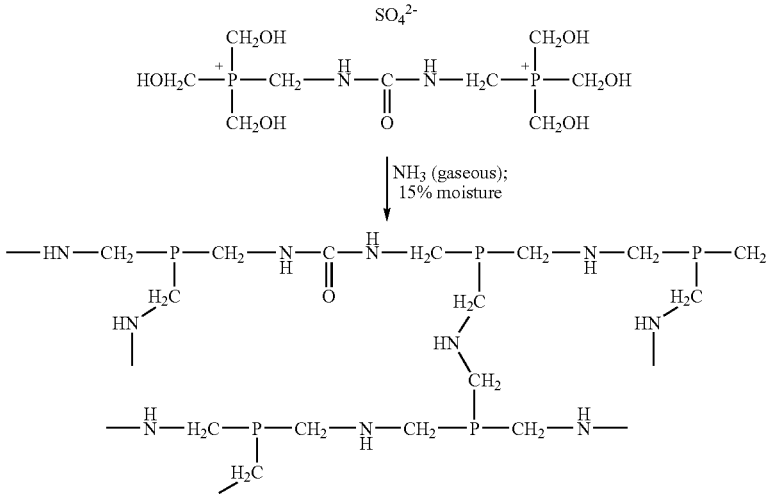

BACKGROUND

The term "flame resistant" is used to describe a material that burns slowly or that is self-extinguishing after removal of an external source of ignition. A fabric or yarn may be flame To fix the flame retardant compound to the fabric surface and to convert the trivalent phosphorous to its stable pentavalent form, the treated fabric is conveyed through a peroxide bath, in which the peroxide oxidizes the phosphorous compound. This step is illustrated below.

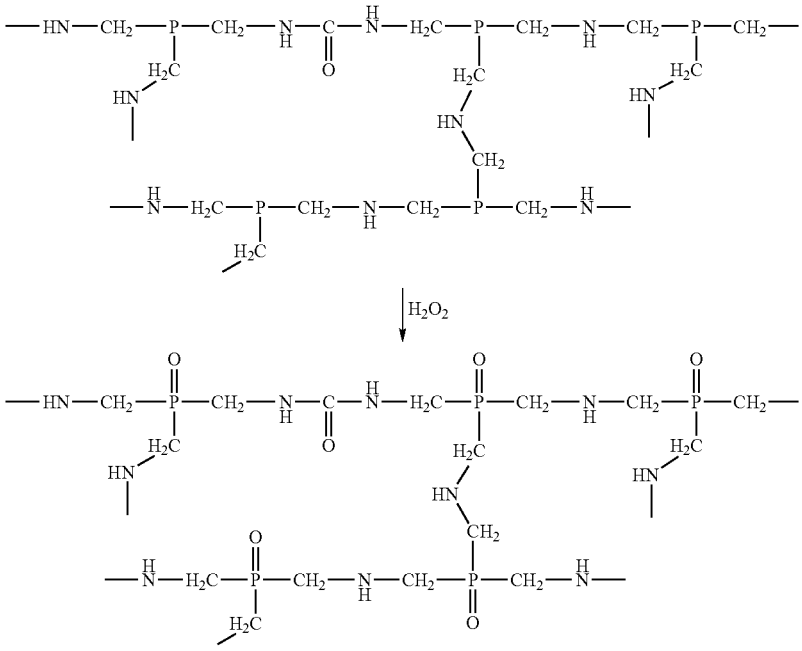

Ammoniated cellulosic fabrics have relatively good flame retardance, particularly in those instances in which cellulosic fibers comprise the majority of the fiber content. Another advantage of such ammonia-treated fabrics is that they tend to exhibit a soft hand and good tear strength.

However, there are several drawbacks that have been identified with the ammoniation process. One obvious disadvantage of this process is the high capital investment associated with installing an ammonia chamber and requisite environmental controls, as well as the expenses associated with its operation and maintenance. Another processing disadvantage is the limitation on the application of other finishing agents (e.g., soil repel agents, stain release agents, permanent press resins, and the like), because these finishing agents require high temperatures for fixation, which would result in the generation of malodors on the treated fabric.

Moreover, in terms of fabric properties, the flame resistant properties produced by this process tend to lack wash durability due to the amine (—NH) linking groups between the molecules and the method of setting the flame retardant chemistry on the fabric. Besides lacking durability to repeated launderings, these fabrics often have poor wrinkle resistance and appearance retention. Also, because the flame retardant chemistry interacts primarily with the cellulosic fibers, the maximum amount of synthetic fiber that may be used is on the order of about 20-30% by weight.

For fabrics having a high cellulosic content (including those made entirely of cellulosic fibers), the present chemistry and process provide a cost-effective solution to the problems outlined above. Such fabrics possess a flame retardant treatment that is durable for multiple industrial launderings, a softness suitable for apparel applications, and an above-average tear strength for flame retardant cellulosic fabrics. The present treated fabrics also exhibit good appearance retention, achieving results similar to those achieved by the separate introduction of permanent press resins. Optionally, additional finishing agents (such as soil repel agents) may be applied to the fabrics, either simultaneously with the flame retardant chemistry or after the application of the flame retardant chemistry, to impart desirable properties without concern over generation of malodors at the temperatures required to heat-set such finishing agents. For these reasons, the present chemistry and process represent an advance over the ammoniation process.

It is well-known that fabrics with such high cellulosic content tend to exhibit deficiencies in terms of durability, abrasion resistance, and drying time. Where these shortcomings pose a serious detriment, manufacturers have tried, with varying degrees of success, to incorporate higher percentages of synthetic fibers into these fabrics. The difficulty with accommodating the desire for more durable substrates are the tendency of the synthetic fibers to burn or melt and the tendency of the (hydrophobic) synthetic fibers to resist penetration of the flame retardant, thereby making them unsuitable for use in large percentages. Thus, when using the ammoniation process to impart flame resistance to fabrics having a blend of cellulosic and synthetic fibers, the amount of synthetic fiber content has heretofore been limited to less than 30%. As mentioned briefly above, the ammonia process tends to preferentially bind the flame retardant chemical to the cellulosic fibers in the fabric.

The present process overcomes the shortcomings of the previous approaches—regardless of the amount of synthetic content in the fabric—by providing an alternative mechanism by which one or more flame retardant chemicals may be fixed on a target textile substrate. As a result, the fabrics exhibit a durable finish, and larger amounts of synthetic fibers may successfully be incorporated into the fabrics without a loss of flame resistance. These larger amounts of synthetic fibers contribute significantly to increasing the durability and the tear strength of the treated fabrics. Even in fabrics having a low synthetic content, the present process imparts flame retardant properties in an economically advantageous way, while overcoming the shortcomings associated with the ammoniation process used previously.

SUMMARY

A process for imparting flame resistance and the flame resistant fabrics produced by such process are provided. The process for imparting flame resistant properties involves treating a target fabric with one or more flame retardant chemicals (and, preferably, a softening agent) and then curing the treated fabric to durably affix the flame retardant to the fabric. In many cases, it may be desirable to subject the treated fabric to mechanical treatment to increase softness for the comfort of the user. Optionally, stain release agents, soil repellent agents, permanent press resins, and the like may be added to the bath of flame retardant chemicals, eliminating the need for one or more additional manufacturing processes. Alternately, soil repellent agents may be applied to only one side of the treated fabric after the application of the flame retardant chemicals. The fabrics produced by the present process exhibit improved performance and tear strength, even after repeated launderings, as compared to conventionally treated fabrics.

BRIEF DESCRIPTION OF THE DRAWINGS

FIG. 1 is a flow chart of representative process steps for imparting flame resistance to target fabrics.

DETAILED DESCRIPTION

Target Textile Fabrics

The process described herein is suitable for use with a variety of textile fabrics, provided the synthetic content does not exceed from about 50% to about 65%. The weight percentages of cellulosic yarns and synthetic yarns contribute significantly to the success of the fabric in meeting flammability and other fabric requirements (for example, durability and hand). In one embodiment, the fabrics have a synthetic content of from about 0% to about 50% and a cellulosic content of from about 50% to about 100%. In a second embodiment, the fabrics have a synthetic content of from about 10% to about 65% and a cellulosic content of from about 35% to about 90%. In yet another embodiment, the fabric may have a synthetic content of from about 10% to about 50% and a cellulosic content of from about 50% to about 90%. While synthetic-containing fabrics may be preferred because of their durability through multiple launderings, the present process is equally applicable to 100% cellulosic fabrics (such as 100% cotton denim).

While the term "synthetic" or "synthetic fiber" generally refers to all chemically produced fibers to distinguish them from natural fibers, and while this process is applicable to most, if not all, synthetic fiber types, the preferred fiber types used herein are thermoplastics. The percentages provided above are applicable to thermoplastic fibers, as well as the broader class of synthetic fibers.

"Thermoplastic" fibers are those that are permanently fusible and that may melt at higher temperatures. Examples of thermoplastic fibers used herein are polyesters (such as polyethylene terephthalate, polypropylene terephthalate, and polybutylene terephthalate), polyolefins (such as polyethylene and polypropylene), polyamides (such as nylon 6, nylon 6,6, nylon 4,6, and nylon 12), polyphenylenesulfide, and the like. Advantageously, the inclusion of such thermoplastic materials into the target fabrics, especially at higher fiber content levels, increases the mechanical properties (i.e., abrasion resistance, durability, etc.) of the treated fabrics. It should be understood that one or more thermoplastic fiber types may be incorporated in the desired content amount with one or more cellulosic fibers.

The term "cellulosic" or "cellulosic fiber" generally refers to a fiber composed of, or derived from, cellulose, which is a chief component of the cell walls of plants. Examples of cellulosic fibers include cotton, rayon, linen, jute, hemp, and cellulose acetate, although the most common example is cotton and, as such, cotton will be the focus of the present disclosure. The cellulosic content of blended fabrics contributes significantly to its hand, drape, and breathability, characteristics which provide comfort to wearers thereof. Moreover, traditional flame retardant processes have preferentially treated the cellulosic content of such blended fabrics, thereby imparting flame resistance to the target fabric.

In the United States, there are two varieties of cotton fibers that are commercially available: the American Upland variety (*Gossypium hirsutum*) and the American Pima variety (*Gossypium barbadense*). So-called "Egyptian" cotton is a variety of Pima cotton, which is often grown in Egypt. Generally, the American Upland fibers—which comprise the majority of the cotton used in the apparel industry—have lengths ranging from about 0.875 inches to about 1.3 inches, while the less common Pima cotton fibers have lengths ranging from about 1.2 inches to about 1.6 inches. Based on this length difference, Pima cotton is also known as "extra long staple" cotton.

Incorporation of Pima cotton into the fabric construction results in a fabric that is more durable and absorbent. Surprisingly, the flame retardant properties are enhanced with the inclusion of Pima cotton in place of, or used in conjunction with, American Upland cotton. These results are even more pronounced with repeated launderings. Preferably, the cotton fibers (regardless of species) have an average length of at least about 1.2 inches. In one embodiment, Pima cotton fibers are used in only the filling direction.

Further, non-thermoplastic synthetic fibers, such as carbon fibers, polyaramid fibers, polyacrylic fibers, aromatic polyamide, aromatic polyester, melamine formaldehyde polymer, polyimide, polysulfone, polyketone, polysulfone amide, and any combination thereof, may also be used in the blended fabrics, provided the content (by weight of the fabric) of such fibers is less than about 35% (that is, the percentage of such non-thermoplastic fibers is between 0% and about 35%). These non-thermoplastic fibers may inherently be flame resistant and may contribute this and/or other desirable properties to the fabric. When present, the non-thermoplastic synthetic fibers are preferably present in an amount of from about 5% to about 35% based on the weight of the fabric; more preferably, in an amount from about 5% to about 15% based on the weight of the fabric. By way of example only, and without limitation, modacrylic fibers comprising vinyl chloride or vinylidene chloride (either with or without antimony oxide) may be combined with cellulosic fibers to construct the fabric, in which case the modacrylic fiber content is from about 5% to about 35% by weight.

The fabrics may be woven, knit, or nonwoven. For apparel applications, woven or knit constructions may be preferred. The fabric may have any suitable fabric weight for the intended application, for example, ranging from about 4 oz/yd$^2$ to about 12 oz/yd$^2$ for apparel and protective end uses.

In one instance, the fabrics used are various woven fabric substrates, having a plurality of warp yarns running lengthwise in the machine direction and a plurality of fill yarns running substantially perpendicularly to the warp yarns (i.e., in the cross-machine direction). While any weave construction may be used, the potentially preferred constructions are twill weaves, in which the weave is characterized by diagonal lines produced by a series of floats staggered in the warp direction, and satin weaves, in which the face of the fabric consists almost completely of warp or filling floats produced in the repeat of the weave. A warp-face twill is one in which the floats are produced by the warp yarns, while a filling-faced twill is one in which the floats are produced by the fill yarns. Various twill patterns, such as 2/1, 3/1, 3/2, 4/1, and the like, may all be used successfully to position more cellulosic yarns on a single side of the fabric. Preferably, the weave pattern—whether plain, twill, or satin—produces a tightly woven substrate with small interstices between adjacent yarns.

The warp yarns are preferably an intimate blend of synthetic and cellulosic fibers, and, in some instances, may be a 50/50 blend of cellulosic and synthetic fibers by weight. In other instances, an 80/20 or 75/25 blend of cellulosic and synthetic fibers (respectively) by weight may be used. The ratio may be modified as necessary to achieve the desired physical properties in the fabric.

The warp yarns are preferably spun yarns. Blends of nylon and cotton fibers and blends of polyester and cotton fibers are well-suited for achieving the flame retardant characteristics sought herein, while imparting the functional attributes of durability, drape, breathability, and the like. In another embodiment, the warp yarns may be comprised of a single fiber type (for example, 100% cotton).

It is to be understood that other warp constructions may also be used, including warps having alternating filament synthetic and cellulosic yarns (as described below) or having alternating intimate blended yarns and filament synthetic yarns, so long as the relative content of the cellulosic and synthetic components falls within the above-prescribed ranges. Particularly, the use of a small amount (by weight) of textured filament synthetic yarns in the fabric construction has been found to dramatically improve the fabric strength, while the cellulosic content ensures that the fabric will exhibit the desired flame retardant performance.

The fill yarns may be one of (i) a blend of synthetic and cellulosic fibers in the form of spun yarns, as provided in the warp direction, (ii) a patternwise arrangement of filament synthetic and cellulosic yarns, and (iii) 100% cellulosic yarns. Exemplary blend ratios (by weight) of cellulosic to synthetic fibers include 90:10, 80:20, 75:25, and 50:50. Again, nylon and cotton yarns are preferred for many applications. In other applications, polyester and cotton yarns may be useful. Filament synthetic yarns (particularly textured filament yarns) are beneficial in providing desired strength and abrasion resistance in the finished fabric. Additionally, textured synthetic yarns provide stretch or elasticity to the fabric for improved fit, flexibility, and comfort.

The term "patternwise arrangement" refers to a repeating pattern of synthetic and cellulosic yarns, found in the warp direction, the fill direction, or both. Representative patterns include 1:2 (one synthetic yarn followed by two cellulosic yarns) and 1:3 (one synthetic yarn followed by three cellulosic yarns). It should be understood that other patterns may also be used, provided the overall content of the cellulosic and synthetic yarns falls within the desired ranges.

In one potentially preferred embodiment, a cellulosic-containing woven fabric is provided, in which the warp yarns are an intimate blend of synthetic and cellulosic fibers and the fill yarns comprise a patternwise arrangement of filament synthetic yarns and cellulosic yarns. In this instance, the ratio of synthetic yarns to cellulosic yarns in the fill direction is preferably one to at least three (that is, at least three cellulosic yarns are used for each synthetic yarn), although other patterns may be used to provide the same fiber content in the finished fabric. In yet another embodiment, a 1:2 ratio of synthetic yarns to cellulosic yarns is used. Preferably, nylon and cotton yarns are used to create this woven fabric.

Once the fabric is constructed (for example, woven or knitted), it is prepared using conventional textile processes, such as desizing, bleaching, and scouring. If desired, the fabric may then be dyed and/or printed. The optionally dyed and/or printed fabric is then treated to obtain flame resistant characteristics, according to the process steps described herein.

Flame Retardant Chemicals

One preferred flame retardant chemistry for this application is the reaction product of tetra (hydroxymethyl) phosphonium ("THP") salt or its condensate with one of urea, guanidines, guanyl urea, glycoluril, and polyamines. In practice, a phosphorous-based component from the THP compound penetrates within the cellulosic fibers, thereby imparting durable flame resistant properties to the treated fabric.

The term "tetrahydroxymethylphosphonium salt" includes the salts of chloride, sulfate, acetate, carbonate, borate, and phosphate. It has been surprisingly found that the tetra (hydroxymethyl) phosphonium sulfate ("THPS") compound performs at least as well as the THP condensates previously used, when combined with one of urea, guanidines, guanyl urea, glycoluril, and polyamines. One example of such a THP salt is a tetra (hydroxymethyl) phosphonium sulfate (having about 77% solids and 11.5% active phosphorous) sold by Cytec Industries of West Paterson, N.J. under the tradename PYROSET® TKOW.

In one embodiment, a THP salt (e.g., a sulfate) is used as the flame retardant compound. The ratio of THP flame retardant to urea, in this instance, is from about 0.75:2 to about 0.75:4. The THP salt concentration ranges from about 25% by weight to about 45% by weight of the formulation solution.

The THP condensate—which is the requisite starting material for the ammoniation process—may include the condensation product of the THP salt with one of urea, guanazole, and biguanide. One example of such a THP condensate is sold under the tradename PYROSAN® C-FR (having about 70% solids and 10% active phosphorous) by Emerald Performance Materials of Charlotte, N.C.

A representative reaction mechanism is shown below. As shown below, the THP salt or the THP pre-condensate is reacted on the fabric with urea to create an intermediate compound in which the phosphorous compound is present in its trivalent form. Such reaction is carried our in the fabric at sufficiently high temperatures to cause the THP (salt or condensate) to form covalent bonds with the cellulosic fibers, thus imparting greater durability of the flame retardant treatment to washing. The curing temperature is not so high that excessive reaction of the flame retardant with the cellulosic fibers occurs, which would otherwise lead to a weakening of the cellulosic fibers (and the fabric). Similarly, curing time must also be controlled carefully to prevent over-reaction of the THP with the cellulosic fibers. Depending on the curing oven used and the heat transfer efficiency, the curing temperature may range from about 149° C. (300° F.) to about 177° C. (350° F.), and the curing time may range from about 1 minute to about 3 minutes.

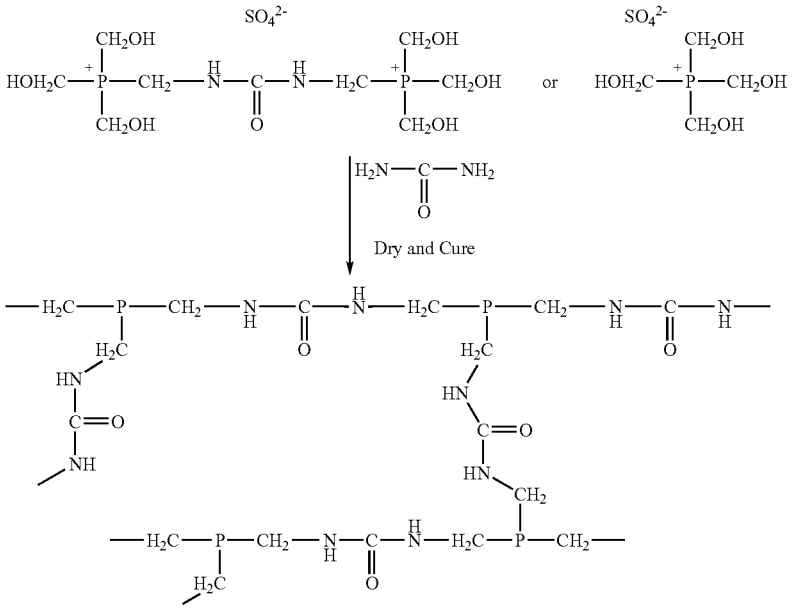

To fix the flame retardant compound to the fabric surface and to convert the trivalent phosphorous to its stable pentavalent form, the treated fabric is conveyed through a peroxide bath, in which the peroxide oxidizes the phosphorous compound. This step is illustrated below.

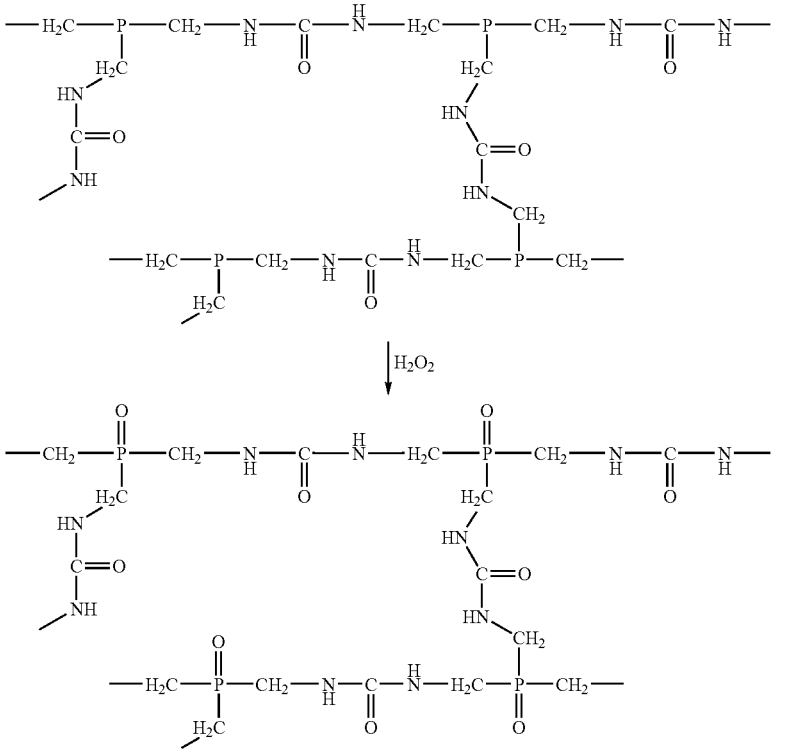

The optimum add-on level of the flame retardant chemical depends on the fabric weight and construction. Usually, for apparel applications where lighter weight fabrics are used, it is preferable to achieve an add-on level of 2.5%-4.0% phosphorous, based on the weight of the untreated fabric. Too little and, ironically, too much flame retardant seem to impair the fabric's ability to meet flammability or mechanical strength standards.

In one embodiment where the target fabric has a high synthetic content (i.e., from about 50% to about 65%), an aromatic halogenated compound is used in addition to the phosphorous-based flame retardant compound. Aromatic halogenated flame retardants possess excellent UV-light stability and excellent heat stability, even at the elevated temperatures associated with curing, as compared with aliphatic halogenated compounds. Preferably, the aromatic halogenated compounds have a melting temperature of equal to or less than about 40° C. (104° F.), making them liquids near room temperature.

The term "aromatic halogenated compound" refers to a compound having at least one halogen radical (e.g., bromine) covalently attached to an aromatic ring structure. Examples of aromatic brominated compounds include, for example, ethane-1,2-bis(pentabromophenyl); tetrabromophthalate esters; tetrabromobisphenyl A and its derivatives; and ethylenebromobistetrabromophthalimide. Other aromatic halogenated compounds, as are known in the art, may be used in place of the brominated compounds listed above.

Representative Process Steps

FIG. 1 provides a flow chart of representative processes for imparting flame resistance to a textile substrate.

Step 10 involves the application of the selected flame retardant chemical(s) to the target textile fabric. An objective of this step of the process is to impregnate the fabric with the treatment chemistry (and optional additives, as will be discussed below), which is accomplished by saturating the fabric with the solution to allow thorough penetration into the fabric. Preferably, this is accomplished by padding—that is, passing the target fabric through an aqueous bath containing a solution of the flame retardant agent and any other desired additives (such as a wetting agent and a buffer agent for pH control) and subsequently through nip rollers. Alternately, the fabric may be sprayed or coated, using any known coating techniques.

Padding may be done on any conventional equipment, but equipment having nip rolls is preferred to ensure good penetration of the bath chemistry into the fabric. Assuming a 60% wet pick-up rate, a typical pad bath created to achieve a 3-4% phosphorous deposit would include roughly 25-50% by weight of a THP salt or a THP condensate, with small amounts of wetting agents, softeners, and buffers (e.g., sodium acetate). It has been found that, to increase the stability of the bath, the components are preferably combined in the following order: wetting agent and water, buffer, softener, and flame retardant(s). Stirring is used to effectuate proper combination.

When the formulation is prepared, a small amount of alkaline material may be added to adjust the pH to the range of about 5 to about 8 and, more preferably, to the range of about 5 to about 7. It has been found that, when the pH is too low, incomplete curing tends to result. Conversely, when the pH is too high, wash durability of the flame resistant finish is adversely affected. Alkaline metal hydroxides, sodium carbonate (soda ash), sodium acetate, and sodium phosphate, for example, may be used to adjust the pH of the formulation.

Preferably, a softening agent (also known as a "softener") is included in the flame retardant chemical bath to significantly improve the hand of the treated fabric. It has been found that the inclusion of a softener also improves the tear strength of the finished fabric. Clearly, the softening agent selected for this purpose should not have a deleterious effect on the flammability of the resultant fabric. For example, silicone and silicone-based softeners (such as polydimethylsiloxane, aminosiloxane, and quarternary silicone) provide excellent hand, but negatively affect the flammability of the fabric. Certain sulfonated oils have also been found to adversely affect flammability. Some softeners, including polyamines and certain quarternary amines, when present in significant amounts, are unsuitable for the present application, because of their instability during curing conditions.

Therefore, cationic softening agents—such as one or more of polyolefins, modified polyolefins, ethoxylated alcohols, ethoxylated ester oils, alkyl glycerides, fatty acid derivatives, fatty imidazolines, parafins, halogenated waxes, and halogenated esters—are used instead to impart softness to the treated fabric. A single softening agent or a combination of different softening agents may be used. Alkylamines and quaternary alkylamines may also be used in small amounts, if combined with another softening agent of the types listed above.

In one embodiment, aromatic halogenated compounds having a melting temperature less than about 40° C. (104° F.), such as those described above, may be used in addition to, or in place of, the previously mentioned softening agents. Such aromatic halogenated compounds provide the dual benefit of imparting flame resistance and softness.

In addition to softening agents, other textile finishing compounds may be added to the bath solution, including, but not limited to, wetting agents, surfactants, stain release agents, soil repel agents, antimicrobial compounds, wicking agents, anti-static agents, antimicrobials, antifungals, and the like. Advantageously, chemicals that require, or benefit from, heat-setting or curing at high temperatures may be successfully incorporated into the flame retardant bath chemistry. As yet another alternative, as will be described further herein, soil repellent chemistry may be applied after the application of the flame retardant chemistry.

One potentially preferred combination of chemistries for imparting wash durable stain resistance and stain release is described in US Patent Application Publication No. 2004/0138083 to Kimbrell et al., the contents of which are hereby incorporated by reference. Briefly, the compositions useful for rendering a substrate with durable stain resistance and stain release are typically comprised of a hydrophilic stain release agent, a hydrophobic stain repellency agent, a hydrophobic cross-linking agent, and optionally, other additives to impart various desirable attributes to the substrate. In this publication, new chemical compositions are contemplated wherein the relative amount and chain length of each of the aforementioned chemical agents may be optimized to achieve the desired level of performance for different target substrates within a single chemical composition.

Hydrophilic stain release agents may include ethoxylated polyesters, sulfonated polyesters, ethoxylated nylons, carboxylated acrylics, cellulose ethers or esters, hydrolyzed polymaleic anhydride polymers, polyvinylalcohol polymers, polyacrylamide polymers, hydrophilic fluorinated stain release polymers, ethoxylated silicone polymers, polyoxyethylene polymers, polyoxyethylene-polyoxypropylene copolymers, and the like, or combinations thereof. Hydrophilic fluorinated stain release polymers may be preferred stain release agents. Potentially preferred, non-limiting, compounds of this type include UNIDYNE® TG-992 and UNIDYNE® S-2003, both available from Daikin Corporation; REPEARL® SR1100, available from Mitsubishi Corporation; ZONYL® 7910, available from DuPont; and NUVA® 4118 (liquid) from Clariant. Treatment of a substrate with a hydrophilic stain release agent generally results in a surface that exhibits a high surface energy.

Hydrophobic stain repellency agents include waxes, silicones, certain hydrophobic resins, fluoropolymers, and the like, or combinations thereof. Fluoropolymers may be preferred stain repellency agents. Potentially preferred, non-limiting, compounds of this type include REPEARL® F8025 and REPEARL® F-89, both available from Mitsubishi Corp.; ZONYL® 7713, available from DuPont; E061, available from Asahi Glass; NUVA® N2114 (liquid), available from Clariant; and UNIDYNE® S-2000, UNIDYNE® S-2001, UNIDYNE® S-2002, all of which are available from Daikin Corporation. Treatment of a substrate with a hydrophobic stain repellency agent generally results in a surface that exhibits a low surface energy.

Hydrophobic cross-linking agents include those cross-linking agents which are insoluble in water. More specifically, hydrophobic cross-linking agents may include monomers containing blocked isocyanates (such as blocked diisocyanates), polymers containing blocked isocyanates (such as blocked diisocyanates), epoxy containing compounds, and the like, or combinations thereof. Diisocyanate containing monomers or diisocyanate containing polymers may be the preferred cross-linking agents. However, monomers or polymers containing two or more blocked isocyanate compounds may be the most preferred cross-linking agents. One potentially preferred cross-linking agent is REPEARL® MF, also available from Mitsubishi Corp. Others include ARKOPHOB® DAN, available from Clariant, EPI-REZ® 5003 W55, available from Shell, and HYDROPHOBOL® XAN, available from DuPont.

The total amount of the chemical composition applied to a substrate, as well as the proportions of each of the chemical agents comprising the chemical composition, may vary over a wide range. The total amount of chemical composition applied to a substrate will depend generally on the composition of the substrate, the level of durability required for a given end-use application, and the cost of the chemical composition. As a general guideline, the total amount of chemical solids applied to the substrate will be found in the range of about 10% to about 40% on weight of the substrate. More preferably, the total amount of chemical solids applied to the substrate may be found in the range of about 20% to about 35% on weight of the substrate. Typical solids proportions and concentration ratios of stain repellency agent to stain release agent to cross-linking agent may be found in the range of about 10:1:0 and about 1:10:5, including all proportions and ratios that may be found within this range. Preferably, solids proportions and concentration ratios of stain repellency agent to stain release agent to cross-linking agent may be found in the range of about 5:1:0 and about 1:5:2. Most preferably, solids proportions and concentration ratios of stain repellency agent to stain release agent to cross-linking agent may be 1:2:1.

The proportion of stain release agent to stain repellency agent to cross-linking agent may likewise be varied based on the relative importance of each property being modified. For example, higher levels of repellency may be required for a given end-use application. As a result, the amount of repellency agent, relative to the amount of stain release agent, may be increased. Alternatively, higher levels of stain release may be deemed more important than high levels of stain repellency. In this instance, the amount of stain release agent may be increased, relative to the amount of stain repellency agent.

Optionally, in addition to, or in place of, the stain release and/or stain repellency agents described above, halogenated lattices may be added to the flame retardant bath to further enhance the durability of the flame resistant finish. The term "halogenated lattices" refers to homopolymers and copolymers of polyvinyl chloride, polyvinylidene chloride, brominated polystyrene, chlorinated olefins, polychloroprenes, and the like.

In some instances, it may be desirable to separately apply the stain release agent and the soil repellent agent. Such process step is shown in FIG. 1 as Step 80, which is further described below.

Returning now to FIG. 1, Step 20 refers to the drying of the treated fabric at low temperatures. In this instance, the term "low temperature" encompasses temperatures generally less than about 150° C. (302° F.) and, most preferably, from about 100° C. (212° F.) to about 150° C. (302° F.). This low temperature drying may occur in any conventional type of drying apparatus for a time sufficient to remove from about 85% to about 100% of the moisture content of the fabric. Although this step is preferred for most applications, particularly for ensuring uniform treatment across the fabric and consistency of flame resistant properties, it may be shortened or replaced by the application of high temperature heat in a single step (Step 30).

Step 30 refers to the curing of the treated fabric at high temperatures. In this case, the term "high temperature" encompasses temperatures ranging from about 150° C. (302° F.) to about 190° C. (374° F.) and, more preferably, from about 160° C. (320° F.) to about 180° C. (356° F.), such temperatures being used for a period of time ranging from about 20 seconds to about 180 seconds. The curing temperature promotes a chemical reaction between the THP flame retardant compound and the hydroxyl groups on the cotton fibers, thereby increasing the wash-durability of the flame retardant treatment. It has been found that temperatures lower than about 150° C. (302° F.) are generally insufficient to cure the flame retardant chemistry and that temperatures higher than about 190° C. (374° F.) tend to promote an excessive reaction between the flame retardant chemistry and the cellulosic fibers that degrades and weakens the fabric. Separate drying and curing steps (20, 30) are preferred, as they provide improved flame retardant properties in the treated fabric, as well as greater process control during manufacturing.

To complete the reaction of the flame retardant chemical within the fabric, the treated fabric should be oxidized to convert the trivalent phosphorous into the innocuous pentavalent form. The oxidation step also helps to remove any residual odor from the cured fabric and to produce maximum durability of the flame retardant fabric for extended washings. Oxidation may occur in a continuous process (such as by impregnating the cured fabric with a peroxide solution on a continuous range) or in a batch process (such as by submerging the cured fabric in a peroxide solution in a bath, vat, or jet vessel).

In a continuous process, such as that shown in FIG. 1, the fabric is conveyed through an aqueous solution of an oxidizing agent (for example, hydrogen peroxide) and, optionally, a wetting agent and/or surfactant, which causes substantial conversion of the phosphine compound mentioned above to a stable and durable pentavalent phosphate compound polymerized within the fabric. The cured fabric is immersed in this peroxide bath, as shown at Step 40, to oxidize the phosphorous compound and to remove odors that may have been generated during the curing process. The peroxide bath contains a solution having from about 3% to about 50% of a peroxide, such as hydrogen peroxide. The preferred period for submersion ranges from about 10 seconds to about 90 seconds. The peroxide bath may optionally be heated to temperatures from about 30° C. (86° F.) to about 50° C. (122° F.).

Step 50 involves the submersion of the fabric in a neutralizing solution made of an appropriate concentration of caustic. Preferably, although not absolutely required, the fabric is immersed in a caustic bath containing from about 2% to about 4% caustic for a period of about 60 seconds. After being immersed in the caustic bath, the fabric is then rinsed in water to remove any residual alkali from the neutralized fabric. Preferably, the water is heated to temperatures from about 49° C. (120° F.) to about 60° C. (140° F.).

Optionally, as shown in Step 60, the fabric is then conveyed through a bath containing from about 0.5% to about 20% and, preferably, from about 0.5% to about 5%, of a reducing agent to reduce the releasable amount of formaldehyde on the fabric. Preferably, the formaldehyde levels are reduced to 300 parts per million or less; more preferably, to 200 parts per million or less. Suitable reducing agents include organic or inorganic compounds that react with formaldehyde at the temperatures mentioned above (that is, from about 20° C. to about 80° C.), examples of which include, but are not limited to, sulfite salts, bisulfite salts (including sodium bisulfite and ammonium bisulfite), thiosulfate salts, urea compounds (including urea, thiourea, ethylene urea, and hydroxyethylene urea), guanazole, melamine, dicyanoamide, biuril, diethylene glycol, phenols, thiophenols, hindered amines, and the like.

It has been found that conveying the fabric through a pad/nip roll set-up is quite effective for this purpose. Preferably, the temperature of the reducing agent bath is from about 20° C. (68° F.) to about 80° C. (176° F.), and the exposure time of the fabric to the bath is about 60 seconds, and the nip roll pressure is from about 15 p.s.i. to about 60 p.s.i. Step 60 may be accomplished in one of two ways: either by immersing the fabric, rinsing the fabric (to remove reducing agent), and passing the fabric through a nip roll or by immersing the fabric and then passing the fabric through a nip roll. This latter approach—in which the rinsing step is omitted—is preferred, as the presence of a small amount of reducing agent on the fabric tends to result in less releasable formaldehyde on the fabric, as compared with the level obtained when the fabric is rinsed.

In step 70, the fabric is then dried at a relatively low temperature (that is, less than the curing temperature) to remove moisture from the fabric. Optionally, the treated fabric may be air dried.

Step 80 refers to the optional application of a soil repellent agent to one side of the fabric. Optionally, a stain release agent may be included with the soil repellent agent. The soil repellent agents and stain release agents are those provided above. The preferred method of application is by foaming, such that the soil repellent agent (and, optionally, the stain release agent) is localized on one side of the treated fabric, preferably the outwardly-facing side of the fabric which is not in contact with the skin of the wearer. Foaming may be achieved by including a foaming agent in the soil repel/stain release agent solution and agitating air into the mixture. Suitable foaming agents include amine oxides, amphoteric surfactants, and ammonium stearates.

Such application, especially of the soil repellent agent, has been found particularly advantageous in extending the useful life of garments made from the treated fabric. It has been well-documented that the useful life of flame retardant garments is often shortened because the garments are soiled by greasy stains, such as oil. Not only are these types of stains difficult to remove with ordinary laundering, but the stains themselves tend to be flammable. Thus, it is advantageous to provide a soil repellent agent to at least the outward-facing side of the treated fabric to prevent such stains from becoming absorbed by the treated fabric. Moreover, it has been found that by applying the soil repellent agent(s) to the outward-facing side of the fabric, the wicking properties of the fabric are maintained, thereby preserving the comfort level for the wearer of the garment.

When Step 80 is used, then Step 90 necessarily follows, which involves the drying and, possibly, curing of the soil repellent agent and/or stain release agent. The temperatures used for such drying and/or curing are typically in the range of about 150° C. (302° F.) to about 190° C. (374° F.), depending on the particular soil repellent agent and, optionally, stain release agent that are used.

It is worth noting that fabrics treated with the ammoniation process (that is, those fabrics that have been treated with a flame retardant chemical and then exposed to gaseous ammonia) may not subsequently be treated with soil repellent agents, as described above, because these soil repellent chemistries typically require high temperature conditions for drying and/or curing. Under these conditions, the ammonia-treated fabric generates offensive odors. Thus, the present process provides a viable means for imparting treated fabrics with soil repellent chemistries, which are unavailable to users of the ammoniation process.

To further enhance the fabric's hand, the fabric may optionally, and preferably, be treated with a mechanical surface treatment, as shown in Step 100. The mechanical surface treatment, as described below, relaxes stress imparted to the fabric during curing and fabric handling, breaks up yarn bundles stiffened during curing, and increases the tear strength of the treated fabric. Because, in most instances, a softener alone is insufficient to impart the desired degree of softness and flexibility in the treated fabric, the use of mechanical surface treatment is recommended.

Representative examples of such mechanical surface treatments include treatment with high-pressure streams of air or water, as described in U.S. Pat. No. 4,837,902 to Dischler; U.S. Pat. No. 4,918,795 to Dischler; U.S. Pat. No. 5,033,143 to Love, III; U.S. Pat. No. 5,822,835 to Dischler; and U.S. Pat. No. 6,546,605 to Emery et al.; intermittent impact against sanding rolls, as described in U.S. Pat. No. 4,631,788 to Otto; treatment with steam jets; needling; particle bombardment; ice-blasting; tumbling; stone-washing; constricting through a jet orifice; and treatment with mechanical vibration, sharp bending, shear, or compression. A sanforizing process may be used in addition to one or more of the above processes to improve the fabric's hand and to control the fabric's shrinkage.

Additional mechanical treatments that may be used to impart softness to the treated fabric, and which may also be followed by a sanforizing process, include napping; napping with diamond-coated napping wire; gritless sanding; patterned sanding against an embossed surface; shot-peening; sand-blasting; brushing; impregnated brush rolls; ultrasonic agitation; sueding; engraved or patterned roll abrasion; impacting against or with another material, such as the same or a different fabric, abrasive substrates, steel wool, diamond grit rolls, tungsten carbide rolls, etched or scarred rolls, or sandpaper rolls; and the like.

An effective mechanical treatment provides a softening effect by breaking up the flame retardant finish, separating the fibers (within the yarn bundle) from one another, and/or flexing the individual yarns, thereby increasing the flexibility and tear strength of the treated fabric. Flexing by high velocity fluid jet and mechanical impingement, for example, produces effective softening of the hand of the treated fabric and improvement in tear strength of the treated fabric.

Importantly, the resulting flame resistant fabrics successfully meet the flammability requirements for many end-uses. Furthermore, these fabrics tend to exhibit the characteristics of fabrics treated with permanent press resins—that is, the tendency to resist wrinkling, to retain its shape, and to retain a crease or pleat through laundering—without the use of additional permanent press resins. These fabrics typically do not require ironing if they are tumble dried, making them advantageous for use as uniform fabrics.

It is believed that the process causes a chemical coupling reaction of the reactive THP or THP condensate with the hydroxyl groups of the cellulosic fibers at elevated curing temperatures, resulting in covalent bonding of the phosphorous flame retardant to the cotton fibers. The reactive THP also cross-links the cotton fibers to one another, in such a manner that the flat-dry appearance of the laundered fabric is improved (that is, when laundered, the treated fabric lies flatter than the untreated fabric).

One method for evaluating the bonding of the cotton fiber to the flame retardant agents is by using the "Cuen test." In this test, the treated fabric is exposed to a 1.0M solution of cupriethylenediamine, a good solvent for cellulosic fiber. If the cellulosic (e.g., cotton) fibers are not bound to the flame retardant, the fibers are dissolved in a minute or less. If the cotton fibers are bound to the flame retardant, then the fibers swell slowly in the solution but do not dissolve. Fabrics produced according to the teachings herein have fibers that do not dissolve in a 1.0M cupriethylenediamine solution, indicating covalent bonding of the phosphorous-based flame retardant agent to the cellulosic fibers.

As mentioned above, stain release agents and/or stain repellency agents may be incorporated, either separately or in combination, into the flame resistant bath to provide the additional properties of stain release and/or stain repellency. These properties may be achieved without the need for subsequent process steps, which increase production time and cost. Moreover, the use of the preferred stain release and stain repel agents described previously has no detrimental effect on the ability of the treated fabric to meet flammability requirements. In some circumstances, the incorporation of these compounds into the flame retardant bath results in improved durability of the flame retardant treatment.

The following non-limiting examples are representative of flame resistant fabrics manufactured according to the present processes.

Example Fabric Substrates

Below are descriptions of the fabrics used to create the flame retardant Example fabrics. All of the fabrics were woven fabrics. Where two fiber types are listed as the warp yarns and/or the fill yarns, these fibers were intimately blended. Fabric C had 44 picks per inch, while Fabric D had 40 picks per inch. Fabrics A and B were constructed as 3×1 left-hand twills, while Fabrics C, D, and E had a satin weave construction.

| FABRIC IDENTIFIER | WARP YARNS | FILL YARNS | FIBER CONTENT RATIO | FABRIC WEIGHT (oz/yd$^2$) |
|---|---|---|---|---|
| A | 75% cotton, 25% nylon | 100% cotton | 88/12 | 7.5 |
| B | 75% cotton, 25% nylon | 100% cotton | 88/12 | 8.2 |
| C | 84% cotton, 16% nylon | 84% cotton, 16% nylon | 84/16 | 7.5 |
| D | 84% cotton, 16% nylon | 84% cotton, 16% nylon | 84/16 | 7.5 |
| E | 80% cotton, 20% polyester | 80% cotton, 20% polyester | 80/20 | 7.5 |

Example Formulations

The following formulations were used in creating the Example fabrics and will be referred to by number, as appropriate. HIPOSOFT® SFBR is a softening agent comprising a mixture of ethoxylated alcohol and alkyl esters.

| COMPONENTS | FORMULATION IDENTIFICATION (parts by weight) | | | |
|---|---|---|---|---|
| (Tradename and Source) | I | II | III | IV |
| Tetrahydroxymethyl phosphonium urea condensate (70% solids, 10% phosphorous) Tradename: PYROSAN ® CFR Manufacturer: Emerald Performance Materials | 40 | 50 | 61 | 0 |
| Tetrahydroxymethyl phosphonium sulfate (77% solids, 11.5% phosphorous) Tradename: PYROSET ® TKOW Manufacturer: Cytec Industries | 0 | 0 | 0 | 45 |
| Softening agent Tradename: HIPOSOFT ® SFBR Manufacturer: Boehme Filatex | 16 | 13 | 16 | 13 |
| Urea Manufacturer: Aldrich Corporation | 7 | 9 | 9 | 13 |
| Sodium hydroxide solution, 12% by weight (to adjust the pH to about 6) | 2 | 2 | 2 | 2 |
| Water | 36 | 26 | 12 | 27 |

A number of Example fabrics were produced by combining one of the Example substrates A-E with one of the Formulations I-IV. The processing steps and conditions for each of these Example fabrics are provided as follows.

These Examples were produced by impregnating the target substrate with a flame retardant solution by padding, resulting in a wet pick-up of about 70% by weight. The fabric was then dried for about 3-4 minutes in a convection oven at a temperature of about 121° C. (250° F.). The fabric was then cured in the same convection oven at a temperature of about 177° C. (350° F.) for about 3 minutes.

The fabric was then immersed in an aqueous solution containing hydrogen peroxide (9% by weight) at about 24° C. (75° F.) for about 90 seconds. Immediately thereafter, the fabric was immersed in an aqueous solution containing sodium hydroxide (2% by weight) at ambient temperature for about 120 seconds. The fabric was then rinsed in tap water 3 to 5 times and dried at about 149° C. (300° F.).

The fabric is subsequently impregnated with about 4% by weight of urea—which acts as a reducing agent to reduce the amount of releasable formaldehyde in the fabric—and dried at 160° C. (320° F.). The resultant fabric has a releasable formaldehyde level from about 100 parts per million to about 280 parts per million.

Finally, the Example fabrics were subjected to mechanical treatment via a plurality of high pressure (40-90 p.s.i.g.) air jets, which induced vibration in the fabric and which resulted in a softening of the fabric hand and an improvement in tear strength. This mechanical treatment is described in detail in U.S. Pat. No. 4,837,902; U.S. Pat. No. 4,918,795; and U.S. Pat. No. 5,822,835, all to Dischler. Example 3, which is a Control Example, was not mechanically treated. Because Example 3 was "treated" only with water, there was no need to soften the fabric hand with mechanical surface treatment.

The various combinations used to make the Examples are documented below.

- Example 1: Fabric A, Formulation II, mechanical surface treatment
- Example 2: Fabric A, Formulation IV, mechanical surface treatment
- Example 3: Fabric A, water only, no mechanical surface treatment (none needed)
- Example 4: Fabric A, Formulation I, mechanical surface treatment
- Example 5: Fabric A, Formulation I (except with the softener omitted and extra water added to equal 100 total parts), mechanical surface treatment
- Example 6: Fabric A, Formulation III, mechanical surface treatment
- Example 7: Fabric B, Formulation II, mechanical surface treatment
- Example 8: Fabric C, Formulation II, mechanical surface treatment
- Example 9: Fabric D, Formulation II, mechanical surface treatment
- Example 10: Fabric E, Formulation II, mechanical surface treatment Evaluation: Flame Resistance and Durability of Flame Resistant Finish The Example fabrics (excluding Example 3) were tested for flame resistance according to National Fire Prevention Association (NFPA) Test Standard 701, entitled "Standard Methods for Fire Tests for Flame Resistant Textiles and Films." The Example fabrics exhibited no melt or drip of molten fabric and no after-flame after removal of the ignition source. The char lengths of the Example fabrics were between 3.5 inches and 4.0 inches. These characteristics are indicative of a successfully treated flame retardant fabric.

Examples 1 and 2 were then subjected to industrial laundering 100 times, according to NFPA Standard 2112, except that the wash temperature was increased to 74° C. (165° F.) instead of 65° C. (150° F.). Following the launderings, the fabrics were evaluated according to NFPA Standard 701.

Example 1 had a char length of 4.3 inches in the warp direction and 4.8 inches in the fill direction. Example 2 had a char length of 3.9 inches in the warp direction and 4.3 inches in the fill direction. Thus, the flame retardant treatments—whether using a precondensate or a salt as the starting material—were durable to repeated launderings. Slightly better durability was achieved with the salt as the starting material.

Evaluation: Flammability

Examples 1 and 7-10 were evaluated for flammability performance, using a "PYROMAN®" device according to ASTM F1930, entitled "Standard Test Method for Evaluation of Flame Resistant Clothing for Protection Against Flash Fire Simulations Using an Instrumented Manikin," using a three-second exposure time. This test method provides a measurement of garment and clothing ensemble performance on a stationary upright mannequin.

Examples 1 and 7-10 were also evaluated for arc protection, according to ASTM F1959, entitled "Standard Test Method for Determining the Arc Rating of Materials for Clothing." This test method is intended for the determination of the arc rating of a material, or a combination of materials. The numbers reported below are the Arc Thermal Performance Values (ATPV) for each Example, where higher numbers are better.

The results of these evaluations are shown in the table below.

| | ASTM F1930 Results | | | ASTM F1959 |
|---|---|---|---|---|
| Example ID | 3rd Degree Burn | 2nd Degree Burn | Total Body Burn | Results ATPV |
| Example 1 | 6.97% | 28.28% | 35.25% | 8.7 |
| Example 7 | 6.97% | 17.21% | 24.18% | 8.4 |
| Example 8 | 6.97% | 13.12% | 20.09% | 10.9 |
| Example 9 | 6.97% | 9.84% | 16.81% | 11.1 |
| Example 10 | 6.97% | 13.12% | 20.09% | 9.5 |

The results surprisingly show that the fabrics having an intimate blend of cellulosic and synthetic yarns in both the warp and the fill (Examples 8, 9, and 10) perform best in terms of flammability.

Evaluation: Tear Strengths

The tongue tear strengths of the fabric were also evaluated, according to test method ASTM ASTM D2261, entitled "Standard Test Method for Tearing Strength of Fabrics by the Tongue (Single Rip) Procedure (Constant Rate-of-Extension Tensile Testing Machine)." This test method measures the tear strength of textile fabrics by the tongue (single rip) procedure, using a recording constant-rate-of-extension-type (CRE) tensile testing machine. The results are shown below.

| Tongue Tear Strength (ASTM D2261) | | |
|---|---|---|
| Example Fabric | Warp Direction | Fill Direction |
| Example 3 (Control) | 5.61 | 8.01 |
| Example 4 (with softener) | 8.73 | 8.40 |
| Example 5 (without softener) | 5.54 | 6.87 |

Thus, the inclusion of a softener (Example 4) increased the tear strength of the treated fabric in both the warp and fill directions. In addition, the Example 4 fabric was considerably softer and more flexible than the Example 5 fabric.

Examples 3, 4, and 6 were evaluated for tear strength, using the Elmendorf tear strength method, which is documented as ASTM D1424-07, entitled "Standard Test Method for Tearing Strength of Fabrics by Falling Pendulum Type (Elmendorf) Apparatus." This test method determines the force required to propagate a single-rip tear starting from a cut in the fabric and using a falling pendulum-type (Elmendorf) apparatus. These evaluations were conducted to determine the effect of the concentration of the flame retardant formulations on the tear strength of the fabrics. The results, which are an average of five separate measurements, are shown below.

Tongue Tear Strength (ASTM D1424)

| Example Fabric | Warp Direction | Fill Direction |
|---|---|---|
| Example 3 (Control) | 5.74 | 5.63 |
| Example 4 (40% FR solution) | 6.81 | 7.09 |
| Example 6 (61% FR solution) | 4.58 | 4.11 |

These results indicate that an excessive amount of flame retardant (such as that used in Example 6) will negatively affect the tear strength of the treated fabric. Additionally, it may be noted that the tear strength is dependent upon the weight of the fabric and the wet pick-up of the fabric. For instance, if the fabric is lightweight, higher concentrations of the flame retardant formulation may be used. If the wet pick-up of the fabric is high, then slightly lower concentrations of the flame retardant formulation may be used, while still the providing the same flame resistant properties.

Evaluation: Appearance

Fabrics were evaluated using AATCC Test Method 124, entitled "Appearance of Fabrics After Repeated Home Laundering." The treated fabrics lie flat after laundering with a rating of 4 on a scale of 1-5 (where higher numbers are better). Both treated and untreated 100% cotton fabrics have a rating of about 1-2.

Thus, the treated fabrics exhibited good wrinkle resistance and appearance retention, both after application of the treatment chemistry and after repeated launderings.

We claim:

1. A flame resistant fabric, said flame resistant fabric comprising:

a fabric substrate, wherein said fabric substrate has cellulosic fibers and synthetic fibers, said cellulosic fibers being present in an amount from about 50% to about 100% of the weight of said fabric and said synthetic fibers being present in an amount from about 0% to about 50% of the weight of said fabric; and a finish applied to said fabric substrate, wherein said finish comprises a phosphorous-containing compound and a softening agent, the phosphorous-containing compound comprising a plurality of pentavalent phosphine oxide groups having amide linking groups covalently bonded thereto, at least a portion of the pentavalent phosphine oxide groups having three amide linking groups covalently bonded thereto.

2. The flame resistant fabric of claim 1, wherein said synthetic fibers are thermoplastic fibers, said thermoplastic fibers being selected from the group consisting of polyesters, polyamides, and polyphenylsulfide.

3. The flame resistant fabric of claim 2, wherein said cellulosic fibers are cotton and said thermoplastic fibers are nylon.

4. The flame resistant fabric of claim 1, wherein said fabric substrate comprises non-thermoplastic synthetic fibers, said non-thermoplastic synthetic fibers being present in an amount from about 5% to about 35% of the weight of said fabric and being selected from the group consisting of carbon, polyaramid, polyacrylic, modacrylic, aromatic polyamide, aromatic polyester, melamine formaldehyde polymer, polyimide, polysulfone, polyketone, polysulfone amide, and any combination thereof.

5. The flame resistant fabric of claim 4, wherein said non-thermoplastic synthetic fibers are modacrylic fibers, said modacrylic fibers comprising a monomer unit selected from the group consisting of vinyl chloride and vinylidene chloride.

6. The flame resistant fabric of claim 1, wherein said fabric substrate is a woven fabric having warp yarns and fill yarns, and wherein both said warp yarns and said fill yarns comprise synthetic fibers in an amount from about 10% to about 35% of the total yarn.

7. The flame resistant fabric of claim 1, wherein said cellulosic fiber is cotton having a staple length of at least 1.2 inches.

8. The flame resistant fabric of claim 7, wherein said cellulosic fiber is Pima cotton.

9. The flame resistant fabric of claim 1, wherein at least a portion of the phosphorous-containing compound is polymerized within at least a portion of the cellulosic fibers.

10. The flame resistant fabric of claim 1, wherein said softening agent comprises one or more of polyolefins, modified polyolefins, ethoxylated alcohols, ethoxylated ester oils, alkyl glycerides, fatty acid derivatives, fatty imidazolines, parafins, halogenated waxes, and halogenated esters.

11. The flame resistant fabric of claim 1, wherein said finish further comprises a reducing agent selected from the group consisting of sulfite salts, bisulfite salts, thiosulfate salts, urea compounds, guanazole, melamine, dicyanoamide, biuril, diethylene glycol, phenols, thiophenols, hindered amines, and combinations thereof.

12. The flame resistant fabric of claim 1, wherein said finish further comprises an aromatic brominated compound selected from the group consisting of ethane-1,2-bis(pentabromophenyl); tetrabromophthalate esters; tetrabromobisphenyl A and its derivatives; and ethylenebromobistetrabromophthalimide.

13. The flame resistant fabric of claim 12, wherein said aromatic brominated compound has a melting temperature of less than about 40° C.

14. The flame resistant fabric of claim 1, wherein at least a portion of the phosphorous-containing compound is covalently bonded to at least a portion of the cellulosic fibers.

15. The flame resistant fabric of claim 1, wherein the amide linking groups are diamides having two nitrogen atoms bonded to a single carbonyl group.

16. The flame resistant fabric of claim 1, wherein at least a portion of the pentavalent phosphine oxide groups conform to the following structure:

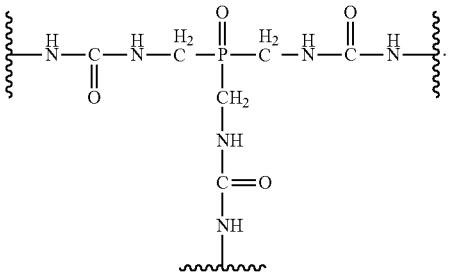

17. A flame resistant fabric, the flame resistant fabric comprising:

(a) a fabric substrate comprising cellulosic fibers, the cellulosic fibers being present in an amount from about 50% to about 100% of the weight of said fabric;

(b) a phosphorous-containing compound, the phosphorous-containing compound comprising a plurality of pentavalent phosphine oxide groups having amide linking groups covalently bonded thereto, at least a portion of the pentavalent phosphine oxide groups having three amide linking groups covalently bonded thereto; and (c) a softening agent.

18. The flame resistant fabric of claim 17, wherein at least a portion of the phosphorous-containing compound is polymerized within at least a portion of the cellulosic fibers.

19. The flame resistant fabric of claim 17, wherein at least a portion of the phosphorous-containing compound is covalently bonded to at least a portion of the cellulosic fibers.

20. The flame resistant fabric of claim 17, wherein the amide linking groups are diamides having two nitrogen atoms bonded to a single carbonyl group.

21. The flame resistant fabric of claim 17, wherein at least a portion of the pentavalent phosphine oxide groups conform to the following structure:

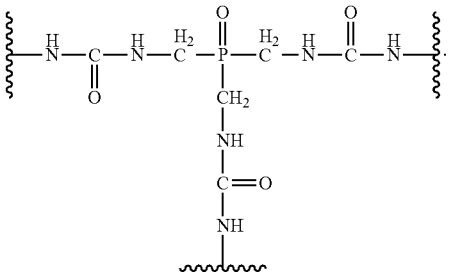

* * * * *